US010882656B2

(12) United States Patent
Woodruff

(10) Patent No.: US 10,882,656 B2
(45) Date of Patent: Jan. 5, 2021

(54) FOLDABLE AND COLLAPSIBLE STORAGE CONTAINERS INCLUDING FOLDABLE STORAGE VOLUME PARTITIONS

(71) Applicant: Lisa Woodruff, West Chester, OH (US)

(72) Inventor: Lisa Woodruff, West Chester, OH (US)

( * ) Notice: Subject to any disclaimer, the term of this patent is extended or adjusted under 35 U.S.C. 154(b) by 55 days.

(21) Appl. No.: 16/115,033

(22) Filed: Aug. 28, 2018

(65) Prior Publication Data

US 2019/0061991 A1 Feb. 28, 2019

Related U.S. Application Data

(60) Provisional application No. 62/550,882, filed on Aug. 28, 2017.

(51) Int. Cl.

| | |
|---|---|
| ***B65D 5/36*** | (2006.01) |
| ***B65D 5/48*** | (2006.01) |
| ***B65D 21/08*** | (2006.01) |
| ***B65D 6/18*** | (2006.01) |
| ***B65D 25/06*** | (2006.01) |
| ***B65D 1/22*** | (2006.01) |
| ***B65D 5/44*** | (2006.01) |
| ***B65D 25/08*** | (2006.01) |

(52) U.S. Cl.

CPC ..... *B65D 5/3628* (2013.01); *B65D 1/225* (2013.01); *B65D 5/48016* (2013.01); *B65D 7/26* (2013.01); *B65D 21/086* (2013.01); *B65D 25/06* (2013.01); *B65D 5/443* (2013.01); *B65D 25/08* (2013.01)

(58) Field of Classification Search

CPC .. B65D 5/3628; B65D 1/225; B65D 5/48016; B65D 7/26; B65D 21/086; B65D 25/06; B65D 25/08; B65D 5/48048; B65D 2571/00808; A45C 7/0036

USPC ..... 229/117.07, 120.17, 120.33, 120.16, 229/120.13, 120.14, 120.15, 120.18; 150/112; 190/107, 109; 206/170; 220/4.08

See application file for complete search history.

(56) References Cited

U.S. PATENT DOCUMENTS 3,039,670 A * 6/1962 Hardon ..... B65D 5/3678 206/521.8
3,092,300 A * 6/1963 Johnson ..... B65D 5/48034 229/120.29
3,193,176 A * 7/1965 Gullickson ..... B65D 5/48048 229/117.06

(Continued)

*Primary Examiner* — Christopher R Demeree
(74) *Attorney, Agent, or Firm* — Dinsmore & Shohl LLP

(57) ABSTRACT

A foldable and collapsible storage container with a bottom wall, and two pairs of parallel side walls. The bottom wall, first pair of side walls and second pair of side walls define a storage volume. A foldable storage volume partition may include a partition wall that extends between the third side wall and the fourth side wall and supports the third side wall and the fourth side wall in an upright position. The foldable storage partition may include a partition bottom hingedly connected to the partition wall that faces the bottom wall. The third and fourth side walls each may include fold locations that divide the third and fourth side walls into a first part and a second part. The partition may engage the third and fourth side walls to inhibit folding of the third and fourth side walls.

20 Claims, 4 Drawing Sheets

(56) References Cited

U.S. PATENT DOCUMENTS

| | | | | |
|---|---|---|---|---|
| 6,736,309 | B1 * | 5/2004 | Westerman | B65D 5/2057<br>229/117.05 |
| 8,985,432 | B2 * | 3/2015 | Cullen | B65D 11/1853<br>206/170 |
| 2001/0017307 | A1 * | 8/2001 | Bentzen | A45F 3/08<br>224/634 |
| 2006/0283926 | A1 * | 12/2006 | Durnin | B65D 5/48048<br>229/120.32 |
| 2014/0251865 | A1 * | 9/2014 | Merrill | A45C 11/20<br>206/546 |

* cited by examiner

FOLDABLE AND COLLAPSIBLE STORAGE CONTAINERS INCLUDING FOLDABLE STORAGE VOLUME PARTITIONS

CROSS-REFERENCE TO RELATED APPLICATIONS

This application claims priority to U.S. Provisional Application No. 62/550,882 filed on Aug. 28, 2017, the entire contents of which are incorporated by reference herein.

TECHNICAL FIELD

The present specification generally relates to storage containers and, more specifically, to foldable and collapsible storage containers including foldable storage volume partitions.

BACKGROUND

Containers come in a variety of shapes and sizes and are suitable for any number of uses. Some containers may be used for storage of items within storage volumes of the containers. Containers may also include storage volumes that are subdivided to allow for some organization of items placed therein.

However, many containers tend to take up significant space when not in use and stored away. To this end, for example, some containers may be stackable or even nested, one container on another container. This can help reduce space occupied by the containers when not in use. What are needed are foldable and collapsible storage containers including foldable storage volume partitions having collapsed configurations that can reduce space occupied by the containers when not in use.

SUMMARY

In one embodiment, a foldable and collapsible storage container may include a bottom wall, a first pair of side walls that extend outwardly from the bottom wall with the storage container in a storage configuration. The first pair of side walls may comprise a first side wall and a second side wall that is substantially parallel to the first side wall with the storage container in the storage configuration. The storage container may further include a second pair of side walls that extend outwardly from the bottom wall with the storage container in the storage configuration, the second pair of side walls comprising a third side wall and a fourth side wall that is substantially parallel to the third side wall with the storage container in the storage configuration, and each comprising a bottom edge and a top edge. The bottom wall, first pair of side walls and second pair of side walls define a storage volume with the storage container in the storage configuration. A foldable storage volume partition may include a partition wall that extends between the third side wall and the fourth side wall and supports the third side wall and the fourth side wall in an upright position with the storage container in the storage configuration. The foldable storage partition may include a partition bottom hingedly connected to the partition wall that faces the bottom wall with the storage container in the storage configuration. The third and fourth side walls each may include a fold location extending from the bottom edge to the top edge of the third and fourth side walls that divide the third side wall into a first part and a second part and the fourth side wall into a first part and a second part. The partition wall may engage the third side wall and the fourth side wall with the storage container in the storage configuration to inhibit folding of the third side wall and the fourth side wall along their respective fold locations.

A foldable and collapsible storage container may include a bottom wall; a first pair of side walls that extend outwardly from the bottom wall with the storage container in a storage configuration. The first pair of side walls may include a first side wall and a second side wall that is substantially parallel to the first side wall with the storage container in the storage configuration and a second pair of side walls that extend outwardly from the bottom wall with the storage container in the storage configuration, the second pair of side walls comprising a third side wall and a fourth side wall that is substantially parallel to the third side wall with the storage container in the storage configuration, and each comprising a bottom edge and a top edge. The bottom wall, first pair of side walls and second pair of side walls may define a storage volume with the storage container in the storage configuration. A removable storage volume partition may include a partition bottom and a partition wall that extends between the third side wall and the fourth side wall and supports the third side wall and the fourth side wall in an upright position with the storage container in the storage configuration. The third and fourth side walls each include a fold location extending from the bottom edge to the top edge of the third and fourth side walls that divide the third side wall into a first part and a second part and the fourth side wall into a first part and a second part. The partition wall may engage the third side wall and the fourth side wall with the storage container in the storage configuration to inhibit folding of the third side wall and the fourth side wall along their respective fold locations.

In yet another embodiment, a method of expanding a storage container from a collapsed configuration to a storage configuration for storing items within the storage container may include providing a storage container comprising a bottom wall and a first and second pair of generally parallel side walls extending from the bottom wall. The second pair of generally parallel side walls may comprise a third and fourth side wall and the third and fourth side wall may include a fold location extending from a bottom edge to a top edge of the third and fourth side walls such that the third and fourth side walls are separated into respective first and second side wall parts at the fold location. The method may further include providing a foldable storage volume partition comprising a partition bottom and a partition wall wherein the partition bottom and the partition wall are foldably coupled along a bottom edge of the partition wall and engaging an inner surface of the third and fourth side walls with an outer edge of the partition bottom such that the third and fourth side walls are prevented from folding by the partition bottom.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein generally relate to foldable and collapsible storage containers including foldable storage volume partitions. The storage containers include a bottom wall and side walls that extend outwardly from the bottom wall to define a storage volume therebetween. In particular, the storage containers may include first and second side walls that may be generally parallel and third and fourth side walls that extend between the first and second side walls. The third and fourth side walls may be generally parallel to each other forming a box-like shape. As will be described in greater detail below, at least one pair of the parallel side walls may each include a fold location where the at least one pair of the parallel side walls can be folded from a storage configuration to a collapsed configuration. A foldable storage volume partition may be located in the storage volume with the storage container in the storage configuration. The foldable storage volume partition may engage the at least one pair of the parallel side walls to inhibit unintended movement of the at least one pair of the parallel side walls from the storage configuration toward the collapsed configuration.

Figure 1:
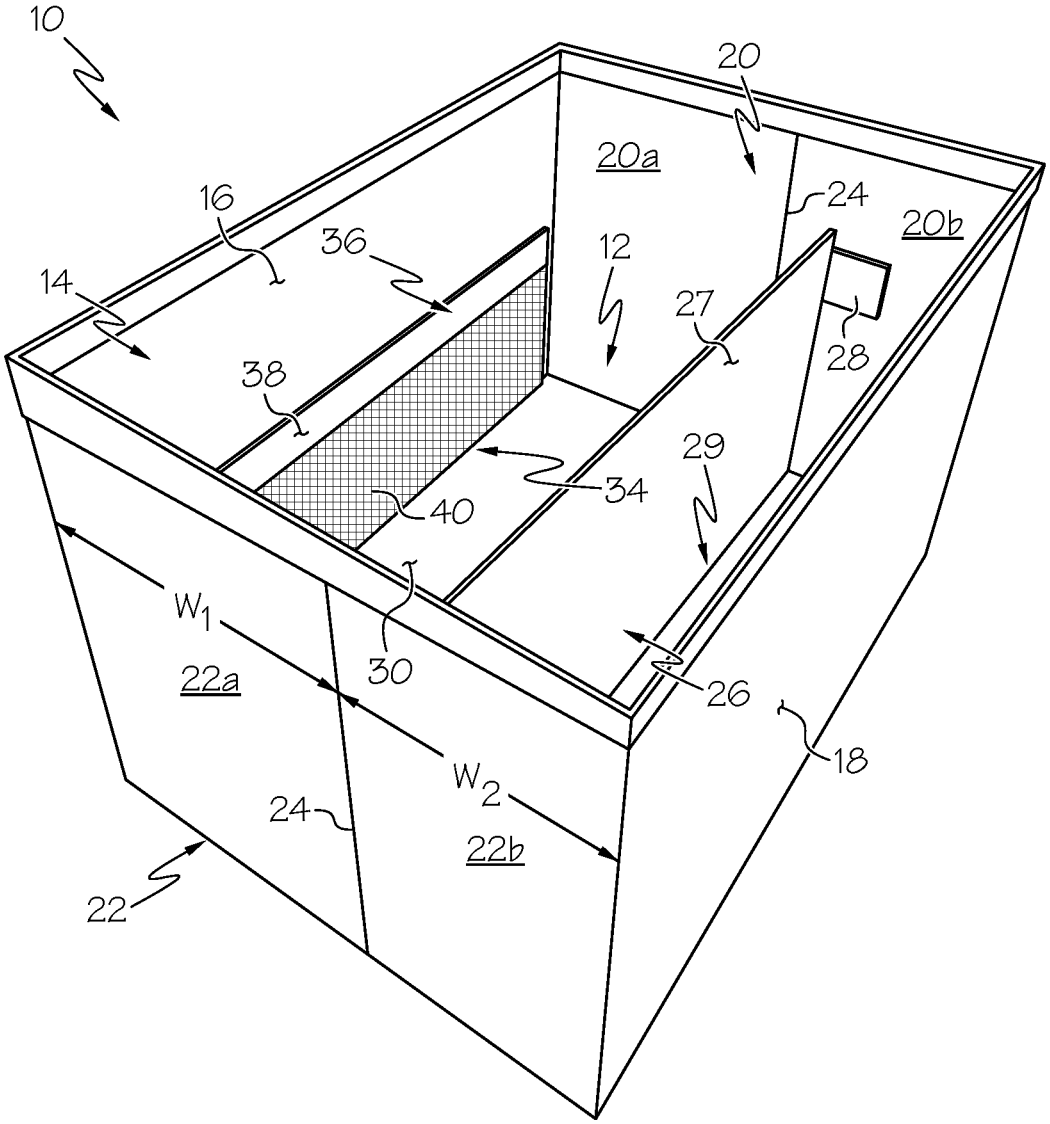
FIG. 1 is a perspective view of one embodiment of a foldable, collapsible storage container including a foldable storage volume partition according to one or more of the embodiments described herein.
Figure 3:
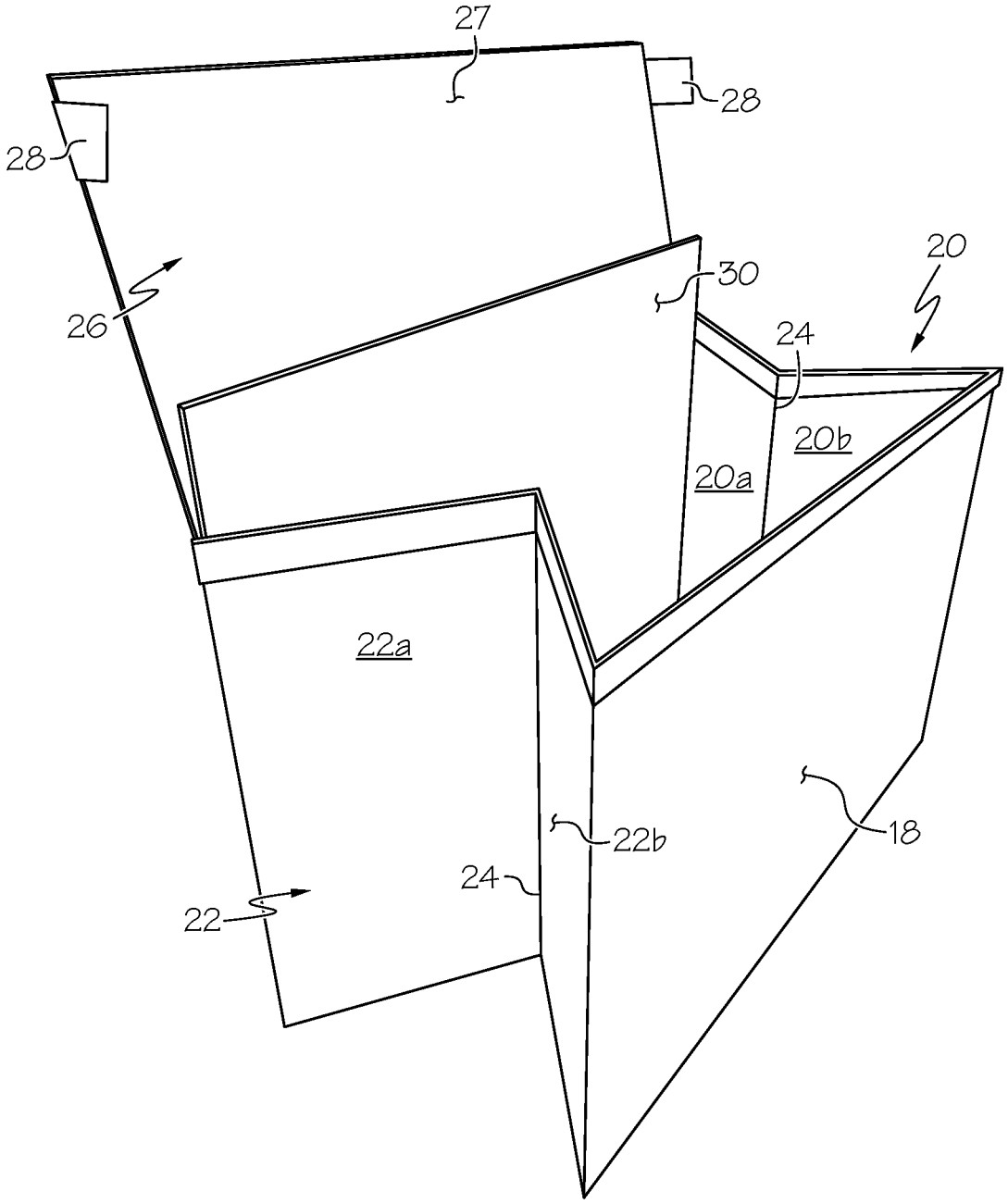
FIG. 3 is a perspective view of one embodiment of the foldable, collapsible storage container of FIG. 1 between a storage configuration and a collapsed configuration.

Referring to FIG. 1, a storage container 10 is illustrated in a storage configuration and includes a bottom wall 12 and side walls that extend outwardly from the bottom wall 12 to define a storage volume 14. In particular, the storage container 10 may include a first side wall 16 and a second side wall 18 that may be generally parallel and a third side wall 20 and a fourth side wall 22 that extend between the first and second side walls 16, 18. The third and fourth side walls 20, 22 may be generally parallel to each other forming a box-like shape. As will be described in greater detail below, at least one pair of the parallel side walls may each include a fold location, such as fold location 24, where the at least one pair of the parallel side walls can be folded from the storage configuration to a collapsed configuration (FIG. 3). A foldable storage volume partition 26 may be installed in the storage volume 14 with the storage container 10 in the storage configuration. The foldable storage volume partition 26 may engage the at least one pair of the parallel side walls, such as, for example, the third and fourth side walls 20, 22, to inhibit unintended movement of the at least one pair of the parallel side walls from the storage configuration toward the collapsed configuration.

In the particular embodiment shown in FIG. 1, the third and fourth side walls 20, 22 each comprise fold locations 24 that may be formed as lines of weakness (e.g., living hinges) that allow the third and fourth side walls 20, 22 to fold therealong. Each of the fold locations 24 separate the third and fourth side walls 20, 22 into parts 20*a*, 20*b*, 22*a*, 22*b*. Parts 20*a* and 22*a* may correspond and parts 20*b* and 22*b* may correspond symmetrically across the storage container 10 such that they have equivalent dimensions and perform similar functions. In some embodiments of the storage container 10, the parts 20*a*, 20*b*, 22*a*, 22*b* are able to fold inward at fold locations 24 when the foldable storage volume partition 26 is removed from an installed position.

As illustrated in FIG. 1, embodiments of the foldable storage volume partition 26 may comprise a partition wall 27, a partition bottom 30 and, one or more tabs 28. The partition wall 27 may be foldably coupled to the partition bottom 30 at a partition fold 29. In some embodiments, the one or more tabs 28 may be releasably or permanently coupled to the partition wall 27 and may be removably affixed to the third and fourth side walls 20, 22 at one or more tab fixture locations 32 (FIG. 2) on the third and fourth side walls 20, 22 such that the foldable storage volume partition 26 may be selectably adjusted between an installed and a removed position. As one example, the tabs 28 may be formed of a flexible material such as a cloth that allows for easy positioning of the tabs 28 against the third and fourth side walls 20 and 22.

For example, in the particular embodiment shown, the tabs 28 are removably fixed to the third and fourth side walls 20, 22 by a hook and loop connection. However, embodiments are not so limited. Any suitable method for removably affixing the foldable storage volume partition 26 to the third and fourth side walls, 20, 22 is contemplated, such as, for example, buttons, looped fasteners, clips, and the like. The one or more tabs 28 hold the partition wall 27 in place along the inner surface of the third and fourth side walls 20, 22. In some embodiments, the one or more tabs 28 are positioned such that the partition wall 27 is held perpendicular to the partition bottom 30 and perpendicular to the third and fourth side walls 20, 22 but embodiments are not so limited.

The partition wall 27 may extend substantially the entire height of a side wall, such as the third and fourth side walls 20, 22. However, embodiments are not so limited, and as shown in FIG. 1, the partition wall 27 may only extend partially up the height of a side wall. Further, as shown, the partition wall 27 may extend substantially perpendicular between the third and fourth side walls 20 and 22 in the storage configuration.

The partition bottom 30 may lie substantially flat along the bottom wall 12 of the storage container 10 when the storage container 10 is in a storage configuration such that the edges of the partition bottom 30 contact the side walls 16, 18, 20, 22 along substantially all of the edge of the partition bottom and all of the side wall. Further, in some embodiments, the edges of the partition bottom 30 may be sized such that when the storage container 10 is in a storage configuration, the edges of the partition bottom 30 extend along the entire length of the respective side wall. In such embodiments the partition bottom 30 spans the entire bottom wall 12 of the storage container 12 such that the third and fourth side walls 20, 22 are prevented from folding inward at fold locations 24.

In some embodiments, the partition bottom 30 is hingedly connected to the storage container 10 at a hinged connection 34, such that the partition bottom 30 can pivot up or down such that the partition bottom 30 is clear of the fold location 24 that can extend along the first side wall 16, allowing the storage container 10 to collapse as will be described in greater detail below. In some other embodiments, there is no hinged connection between the partition bottom 30 and the bottom wall 12 of the storage container 10 such that the entire foldable storage volume partition 26 including the partition bottom 30 is removable from the storage container 10 to facilitate placement of the storage container 10 in the collapsed configuration.

Figure 4:
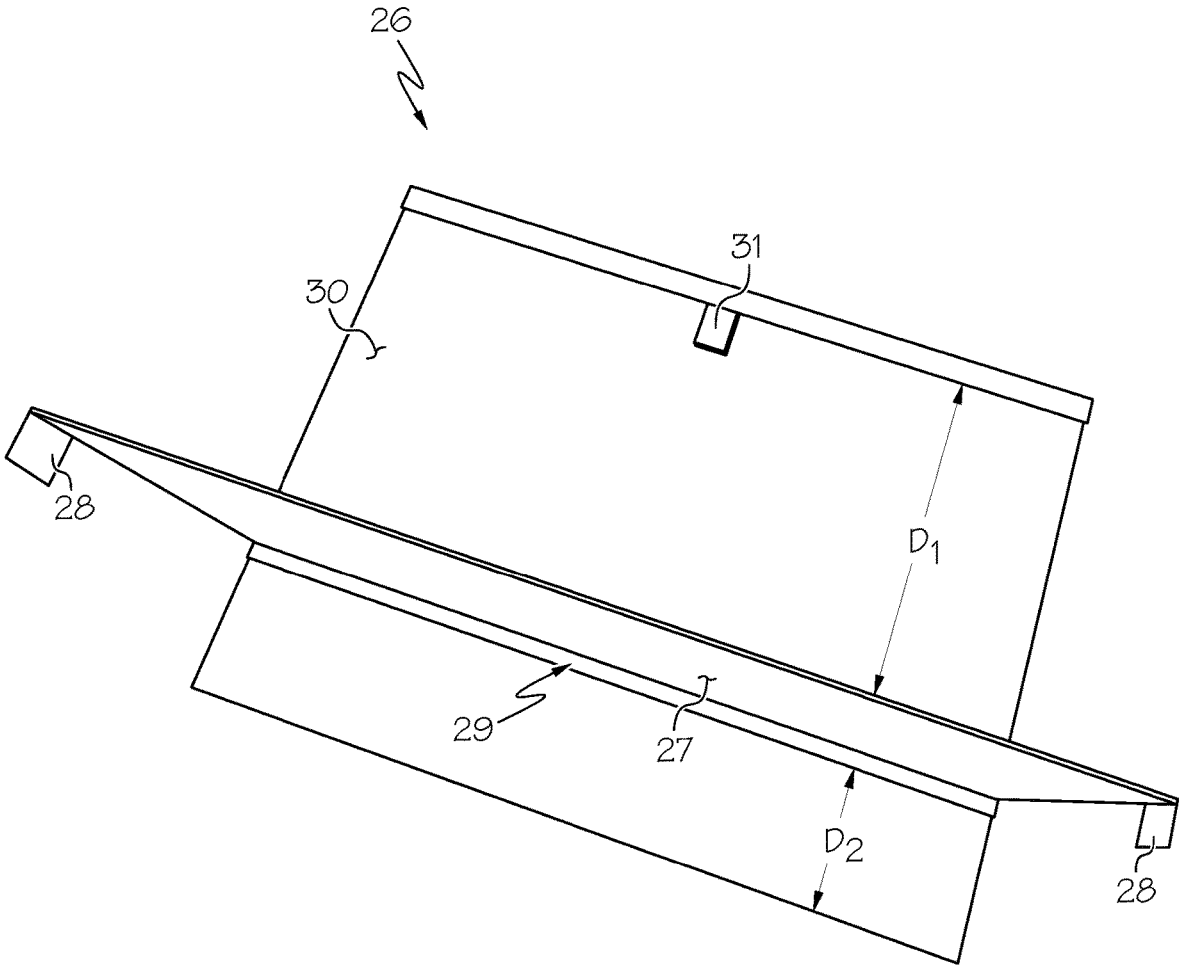
FIG. 4 is a perspective view of one embodiment of a foldable storage volume partition removed from the foldable, foldable storage volume partition of FIG. 1.

In some embodiments, the partition bottom comprises a major dimension $D_1$ and a minor dimension $D_2$ (FIG. 4). The partition wall 27 may extend upwardly from the junction of the two dimensions. Additionally, as shown in FIG. 1, the parts 20*a*, 20*b*, 22*a*, 22*b* of the third and fourth side walls 20, 22 may have equal widths $W_1$ and $W_2$, respectively (FIG. 1). Further, in some embodiments, $D_1$ may be greater than $W_1$ such that the partition wall 27 is not equidistant (with respect to a distance from either the first or second side walls) with the fold location 24 as depicted in the example embodiment of FIG. 1. This arrangement ensures that the partition wall 27 will extend upward along and generally in contact with one of the side wall parts 20*a*, 20*b*, 22*a*, 22*b* such that the part is prevented from folding inward, thus providing an additional feature to prevent the collapsible storage container from folding inward to the collapsed position. This arrangement also allows the major dimension $D_1$ of the partition bottom 30 to extend across the fold locations 24 which can provide added stability for the storage container 10 in the storage configuration.

Still referring to FIG. 1, some embodiments of the storage container 10 include a pocket 36. The pocket 36 may serve as a pocket for holding various items, such as, for example, pens, binder clips, change, and the like. Some embodiments of the pocket 36 include a band 38 and/or a mesh netting 40. The band 38 may be formed from a generally elastic material that is installed with a slight stretch such that the band 38 is under a slight but constant tensile force keeping the band 38 in contact with the side wall to which it is installed, for example, the first side wall 16. As exemplified in FIG. 1, the pocket 36 and band 38 span the entire length of the side wall 16 but embodiments are not so limited. Embodiments are contemplated having a pocket 36 that does not span the entire length of the side wall or having a plurality of smaller pockets that may or may not span the entire length of the side wall.

In the embodiment shown in FIG. 1, the pocket 36 comprises the mesh netting 40 but embodiments are not so limited. The mesh netting 40 allows the storage container user to see what is held in the pocket 36 without having to open the pocket 36. Additionally, the mesh netting 40 may be lighter than other fabrics that may be used reducing the overall weight of the storage container 10. Some embodiments of the storage container 10 comprise one or more pockets, such as pocket 36, on multiple side walls, such as, for example, embodiments having a pocket along the first side wall 16 and the second side wall 18.

Figure 2:
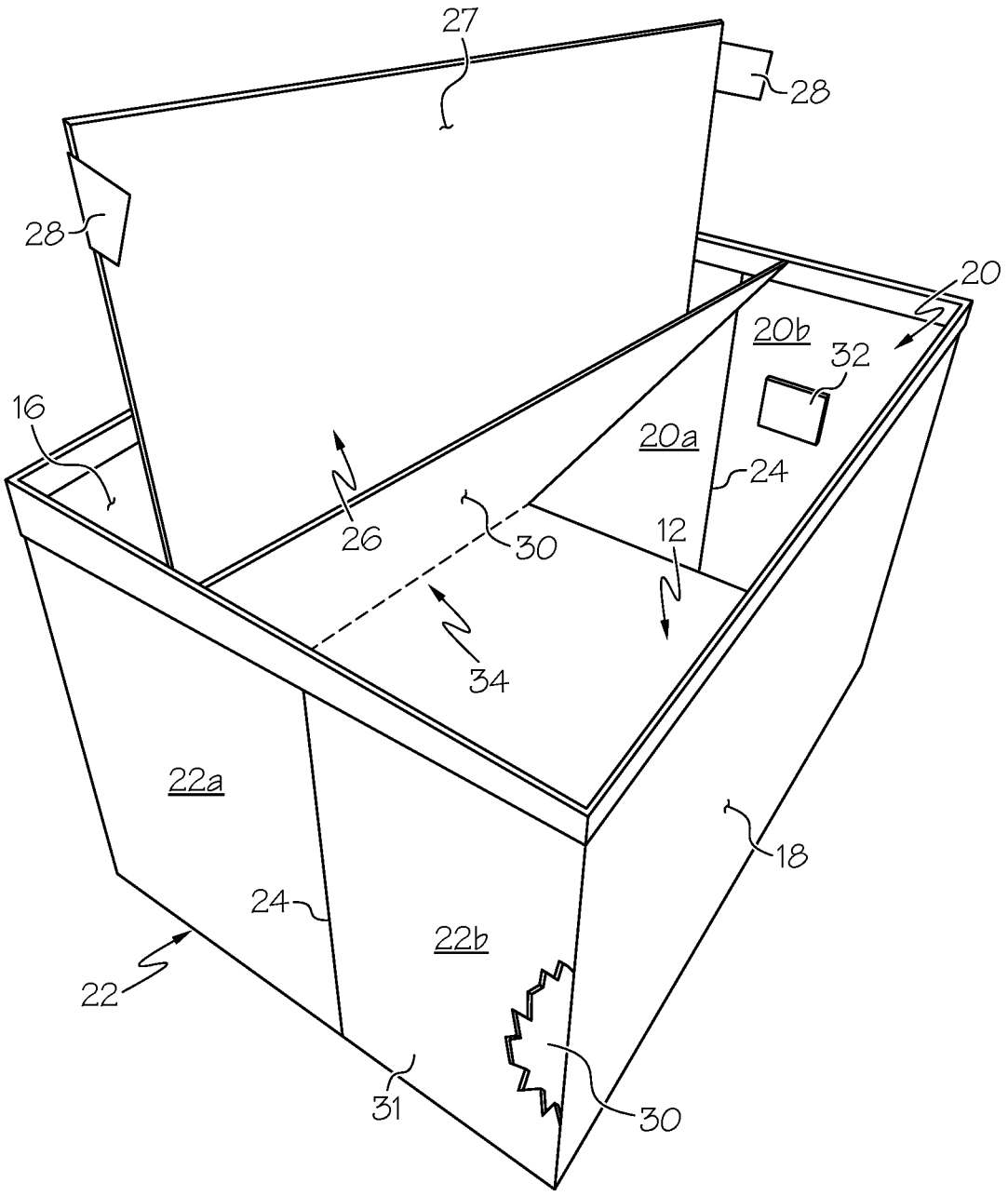
FIG. 2 is a perspective view of one embodiment of the foldable, collapsible storage container of FIG. 1 between a storage configuration and a collapsed configuration.

Referring now to FIGS. 2 and 3, the transition of the storage container 10 from the storage configuration to the collapsed configuration will be described. As shown in FIG. 2, the foldable storage volume partition 26 may be at least partially removable from the storage container 10. The one or more tabs 28 are removed from the tab fixture locations 32 on the third and fourth side walls 20, 22 and the foldable storage volume partition 26 is pulled upward. Because the partition wall 27 is hingedly coupled to the partition bottom 30 at the partition fold 29 (FIG. 1), the partition bottom 30 is also pulled from the storage container 10. Once the partition bottom 30 is clear of the fold location 24, the third and fourth side walls 20, 22 can fold inward. In FIG. 3, the foldable storage volume partition 26 is shown pivoted past the fold location 24 and the storage container 10 is shown in between the storage configuration and the collapsed configuration. The inward folding of the surfaces of the storage container 10 may continue past the fold position shown in FIG. 3 until the storage container is in a collapsed configuration wherein the storage container takes a generally flat profile, reducing the volume of the container.

To facilitate collapsing the storage container 10, the various surfaces such as the bottom wall and the side walls may be collapsibly joined. Collapsible joints may be formed by covering a rigid surface in a foldable or bendable material and joining the edges of the foldable or bendable material, such as by sewing, hemming, or the like. For example, in some embodiments, the walls or wall surfaces may comprise a reinforcement member 30 and be covered in a fabric, such as a fabric covering 31. The fabric covering 31 may comprise cotton, polyester, nylon, or the like. In some embodiments, the covers of all the surfaces will be the same material but embodiments are not so limited. In some embodiments, one or more of the various walls of the storage container 10 comprise the reinforcement member 30. The reinforcement member 30 may be comprised of cardboard, plastic, particle board, or any other suitable material or combination of suitable materials such that the cloth or other material forming the outside of the wall is reinforced.

In some embodiments, various surfaces may only comprise a cloth material. For example, in some embodiments, the bottom wall 12 consists of a cloth material and the side walls are comprised of a cloth cover reinforced by plastic. This particular example arrangement may facilitate collapsing of the storage container 10 because the bottom wall 12 will affect negligible resistance to the collapsing of the storage container.

FIG. 4 shows the foldable storage volume partition 26 isolated from the storage compartment 10. FIG. 4 may also show another embodiment where the foldable storage volume bottom partition 26 is completely removable from the storage container 10. As shown in FIG. 4, the partition fold 29 may be formed by stitching two pieces of fabric together along their edge. In the example embodiment depicted in FIG. 4, the partition bottom 30 and the partition wall 27 are each comprised of a flat rigid surface, such as a piece of cardboard, and enclosed in a fabric covering. The fabric covering each of the surfaces that make up the partition wall 27 and the partition bottom 30 may be joined at the partition fold 29, such as, for example, by a hem or a stitch across the length of the partition fold. In this way, the partition fold 29 is foldable, but also permanent. In some embodiments, the partition bottom 30 and the partition wall 27 are coupled along at least a portion of the partition fold 29. Other surfaces of the storage container may joined in a similar fashion, such as, for example, when the third and first side walls 20, 16 are joined along one of their respective edges.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A foldable and collapsible storage container comprising:

a bottom wall;

a first pair of side walls that extend outwardly from the bottom wall with the storage container in a storage configuration, the first pair of side walls comprising a first side wall and a second side wall that is substantially parallel to the first side wall with the storage container in the storage configuration;

a second pair of side walls that extend outwardly from the bottom wall with the storage container in the storage configuration, the second pair of side walls comprising a third side wall and a fourth side wall that is substantially parallel to the third side wall with the storage container in the storage configuration, and each comprising a bottom edge and a top edge;

the bottom wall, first pair of side walls and second pair of side walls define a storage volume with the storage container in the storage configuration;

a foldable storage volume partition comprising a partition wall that extends between the third side wall and the fourth side wall and supports the third side wall and the fourth side wall in an upright position with the storage container in the storage configuration, the foldable storage partition further comprising a partition bottom hingedly connected to the partition wall that lies substantially flat along the bottom wall;

wherein the third and fourth side walls each include a fold location extending from the bottom edge to the top edge of the third and fourth side walls that divide the third side wall into a first part and a second part and the fourth side wall into a first part and a second part, wherein the partition wall engages the third side wall and the fourth side wall and the partition bottom lies substantially flat against the bottom wall with the storage container in the storage configuration to inhibit folding of the third side wall and the fourth side wall along their respective fold locations.

2. The storage container of claim 1, wherein the partition bottom is hingedly connected to the storage container.

3. The storage container of claim 1, wherein the storage container further comprises one or more tabs that removably couple the partition wall to the third and fourth side walls.

4. The storage container of claim 3, wherein the one or more tabs are permanently fixed to the partition wall and removably coupled to the third and fourth side walls when the foldable storage volume partition is in an installed position.

5. The storage container of claim 3, wherein the one or more tabs are permanently fixed to the third and fourth side walls and removably coupled to the partition wall when the foldable storage volume partition is in an installed position.

6. The storage container of claim 1, wherein the partition bottom comprises a major dimension and a minor dimension separated by the partition wall and the major dimension is greater than a width of the respective first side wall parts of the third and fourth side walls.

7. The storage container of claim 1, wherein the fold location in both of the third and fourth side walls is equally distant from the first and second side walls, such that the third and fourth side walls are each sectioned into equally sized side wall parts.

8. The storage container of claim 1, wherein at least one of the first and second side walls comprises a pocket.

9. The storage container of claim 1, wherein the first, second, third, and fourth side walls comprise a reinforcement member covered in a fabric covering.

10. A foldable and collapsible storage container comprising:

a bottom wall;

a first pair of side walls that extend outwardly from the bottom wall with the storage container in a storage configuration, the first pair of side walls comprising a first side wall and a second side wall that is substantially parallel to the first side wall with the storage container in the storage configuration;

a second pair of side walls that extend outwardly from the bottom wall with the storage container in the storage configuration, the second pair of side walls comprising a third side wall and a fourth side wall that is substantially parallel to the third side wall with the storage container in the storage configuration, and each comprising a bottom edge and a top edge;

the bottom wall, first pair of side walls and second pair of side walls define a storage volume with the storage container in the storage configuration;

a removable storage volume partition comprising a partition bottom that lies substantially flat along the bottom wall and a partition wall that extends between the third side wall and the fourth side wall and supports the third side wall and the fourth side wall in an upright position with the storage container in the storage configuration;

wherein the third and fourth side walls each include a fold location extending from the bottom edge to the top edge of the third and fourth side walls that divide the third side wall into a first part and a second part and the fourth side wall into a first part and a second part, wherein the partition wall engages the third side wall and the fourth side wall and the partition bottom lies substantially flat against the bottom wall with the storage container in the storage configuration to inhibit folding of the third side wall and the fourth side wall along their respective fold locations.

11. The storage container of claim 10, wherein the storage container further comprises one or more tabs that removably couple the partition wall to the third and fourth side walls.

12. The storage container of claim 11, wherein the one or more tabs are permanently fixed to the partition wall and removably coupled to the third and fourth side walls when the storage volume partition is in an installed position.

13. The storage container of claim 12, further comprising one or more tabs that removably couple the partition wall to the third and fourth side walls.

14. The storage container of claim 10, wherein the removable storage volume partition comprises a folding connection between the partition bottom and the partition wall.

15. The storage container of claim 14, wherein the partition wall divides the partition bottom into a major dimension and a minor dimension and the major dimension is greater than a width of the first part of the third and fourth side walls of the storage container.

16. The storage container of claim 10 wherein the bottom wall comprises a cloth material and the first and second side walls and the third and fourth side wall comprise a cloth material reinforced by a rigid material.

17. The storage container of claim 10 wherein the rigid material comprises plastic or cardboard.

18. A method of expanding a storage container from a collapsed configuration to a storage configuration for storing items within the storage container comprising:

providing a storage container comprising a bottom wall and a first and second pair of generally parallel side walls extending from the bottom wall, wherein the second pair of generally parallel side walls comprises a third and fourth side wall and the third and fourth side wall comprise a fold location extending from a bottom edge to a top edge of the third and fourth side walls such that the third and fourth side walls are separated into respective first and second side wall parts at the fold location, providing a foldable storage volume partition comprising a partition bottom that lies substantially flat along the bottom wall and a partition wall wherein the partition bottom and the partition wall are foldably coupled along a bottom edge of the partition wall, engaging an inner surface of the third and fourth side walls with an outer edge of the partition bottom, wherein the partition bottom lies substantially flat against the bottom wall with the storage container in the storage configuration such that the third and fourth side walls are prevented from folding by the partition bottom.

19. The method of claim 18, wherein:

the partition wall engages the third and fourth side walls and prevents the third and fourth side walls from folding.

20. The method of claim 18, wherein:

the partition wall comprises one or more tabs that removably couple the partition wall to the third and fourth side walls.

* * * * *